US007131935B2

(12) United States Patent
Wang

(10) Patent No.: US 7,131,935 B2
(45) Date of Patent: Nov. 7, 2006

(54) OVAL-TRACKED EXERCISE APPARATUS WITH AN ADJUSTABLE EXERCISE TRACK (II)

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/047,484

(22) Filed: Feb. 1, 2005

(65) Prior Publication Data

US 2006/0172864 A1 Aug. 3, 2006

(51) Int. Cl.
*A63B 22/04* (2006.01)
*A63B 22/06* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 6,248,045 B1 * 6/2001 Stearns et al. ..... 482/52
6,361,476 B1 * 3/2002 Eschenbach ..... 482/52
6,422,977 B1 * 7/2002 Eschenbach ..... 482/52
6,440,042 B1 * 8/2002 Eschenbach ..... 482/52

* cited by examiner

*Primary Examiner*—Stephen R. Crow
(74) *Attorney, Agent, or Firm*—Troxell Law Office, PLLC

(57) ABSTRACT

An oval-tracked exercise apparatus with an adjustable exercise track having a frame unit consisting of an upright frame and a base frame. A hanging handlebar is provided at both sides of the upright frame. One end of two planks is pivotally attached to the bottom end of the handlebars while the other end thereof moves up and down in alternating succession above the base frame. In this way, an oval walking track can be simulated in treading the treadles. The upright frame is movable in reciprocating state by use of a rack. A drive mechanism is employed to manually or automatically control the movement of one of both frames to a preset position so that both handlebars can be synchronically adjusted to simulate an oval-tracked walking exercise in uphill or downhill position.

4 Claims, 6 Drawing Sheets

OVAL-TRACKED EXERCISE APPARATUS WITH AN ADJUSTABLE EXERCISE TRACK (II)

BACKGROUND OF THE INVENTION

1. Fields of the Invention

The invention relates to an oval-tracked exercise apparatus, and more particularly, to an exercise apparatus in which the oval track movement is adjustable to allow the simulation of walking exercise in an uphill or a downhill position.

2. Description of the Related Art

A conventional oval-tracked exercise apparatus includes a main body consisting of an upright frame and a base frame both of which are connected to each other. Two planks each have one end pivotally connected with a corresponding handlebar and the other end connected with a crank to create an alternating movement. In treading treadles on the planks, an oval track movement can be simulated for the purpose of taking a jogging exercise In order to facilitate the swing movement of the operator's hands during the exercise session, handlebars are provided for simulating the walking action. As shown in FIG. 5, TW 86218424 teaches an oval-tracked exercise apparatus that includes a main body consisting of a lower frame A01 and an upper frame A02. The upper frame A02 and an auxiliary frame A03 are attached to a cross bar A21. A front upright tube A23 is pivotally connected to each end of the cross bar A21. Moreover, a connecting rod A12 with one treadle A11 is pivotally connected to the bottom end of the hanging tubes A23. The bottom end of each treadle A11 is positioned on a crank A14 of a flywheel A13 rotatably mounted on the lower frame A01. In this way, an oval exercise tract can be simulated for an up-and-down movement in alternating succession. A handlebar A22 is received within each of the front upright tubes A23; meanwhile, its length is adjustable according to the height of the operator. The handlebars A22 can be gripped by the operator's hands during the exercise session to keep his balance.

Moreover, another oval-tracked exercise apparatus has been developed for simulating a walking exercise in uphill or downhill position. As shown in FIG. 6, TW 86218424 teaches an oval-tracked exercise apparatus that includes a main frame consisting of an upright frame B01 and a base frame B02. A handlebar B22 is pivotally connected to the right and the left side of the upright frame B01. Meanwhile, the hanging handlebars B22 are pivotally attached to the adjusting rods B21 and the connecting rods B12 with treadles B11. The distal end of the adjusting rods B21 is in connection with the slide rod B23 while the front end of the slide rod B23 is mounted on cranks B14 of a flywheel B13 rotatably fitted to the base frame B02. In addition, rollers B24 are slid ably mounted on the base frame B02. The angle of the slide rod B23 is adjustable by the adjusting rods B21 on the handlebars B22. In this way, the walking exercise in uphill or downhill position can be indirectly simulated due to the change of the angle when the treadles B11 move on the slide rod B23 in an oval exercise track.

As shown in FIG. 7, TW 92220374 teaches still another oval-tracked exercise apparatus that includes a main frame consisting of an upright frame C01 and a base frame C02. A handlebar C22 is pivotally connected to the right and the left side of the upright frame C01 in a hanging state. One end of two planks C12 is adjustably attached to the corresponding handlebar C22 while the other end thereof is mounted on cranks C14 of a flywheel C13 rotatably attached to the base frame C02. In treading the planks C12, both planks C12 will move up and down in alternating succession under the influence of the crank C14, thereby simulating an oval walking track. Also, the uphill and the downhill walking state can be synchronically simulated by adjusting the position of the adjusting member C21 on the handlebar C22.

From the above-mentioned development of the oval-tracked exercise apparatus, we may find a common drawback that an adjustment along the handlebar must be carried out to achieve a desired walking exercise in uphill or downhill position. In this way, the right and the left handlebar each have to be carefully adjusted in changing the walking exercise in uphill or downhill position for achieving the balance sense during the exercise session. This wastes, however, much time and effort.

SUMMARY OF THE INVENTION

It is a primary object of the invention is to provide an exercise apparatus having a frame unit consisting of an upright frame and a base frame. A hanging handlebar is provided at both sides of the upright frame. One end of two planks is pivotally attached to the bottom end of the handlebars while the other end thereof moves up and down in alternating succession above the base frame. In this way, an oval walking track can be simulated in treading the treadles. The upright frame is movable in reciprocating state by use of a rack. A drive mechanism is employed to manually or automatically control the movement of one of both frames to a preset position so that both handlebars can be synchronically adjusted to simulate an oval-tracked walking exercise in uphill or downhill position.

Another object of the invention is to provide an exercise apparatus that can synchronically adjust the planks at both sides to simulate the oval tracked walking exercise in uphill and downhill position for achieving balance during the exercise session.

A further object of the invention is to provide an exercise apparatus that includes a frame unit which is reciprocatingly movable for adjusting the inclination of the planks in relation to the handlebars.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
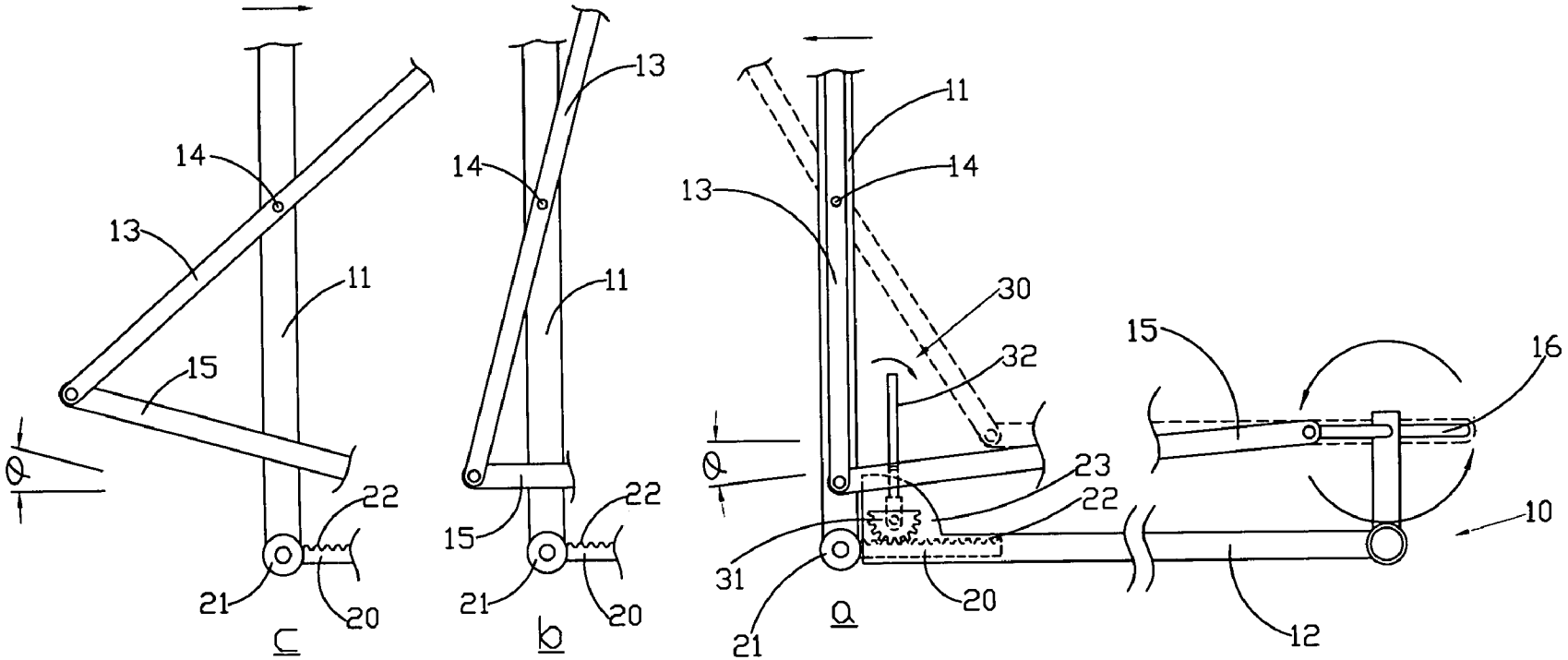
FIG. 1 is a schematic drawing of an oval-tracked exercise apparatus of the invention with a manually operated drive mechanism wherein the change of the relative position between the planks and the handlebars during the shift of the upright frame is illustrated.

Referring to FIG. 1, a frame unit 10 consists of an upright frame 11 and a base frame 12. Two handlebars 13 are attached to the right and the left side of the upright frame 11, respectively, and they are freely swingable at a hinge joint 14. Two planks 15 each have one end pivotally connected with the corresponding handlebar 13 and the other end connected with a crank 16 to create an up-and-down movement in alternating succession. In treading the treadles 18, an oval track movement can be simulated for the purpose of taking a jogging exercise. Meanwhile, the handle bars 13 can be moved to and fro in alternating succession.

The upright frame 11 and the base frame 12 are joined together by use of a guide rail 20 to form a detachable frame unit 10. The upright frame 11 can be driven by a drive mechanism 30 under the guide action of the guide rail 20 and the base frame 12 to allow the upright frame 11 to be extended or retracted. Moreover, rolling elements 21 in contact with the ground are fitted to the bottom of the frame unit 10 for reducing the friction and ensuring a more smooth reciprocating movement. The structure of the drive mechanism 30 will be detailed hereinafter. As shown in FIG. 1, the handle bar 13 and the plank 15 facing the sight of the observer are marked in continuous line while the handle bar 13 and the plank 15 that become invisible due to the upright frame 11, are marked in dashed line, thereby avoiding unnecessary confusion. The handle bar 13 and the plank 15 hereinafter are drawn in continuous line.

The upright frame 11 of the frame unit 10, as shown in section (a) of FIG. 1, and the handle bars 13 pivotally connected with the planks 15 are perpendicular to the base frame 12. Supposed that the crank 16 is situated in a balance state due to the uniform distribution of the weight of both planks 15, the plank 15 from the lower end of the handle bars 13 to the crank 16 is inclined at an angle of θ in a downhill position. In this way, a downhill walking exercise may be simulated when the operator treads on the planks 15 for an oval-tracked walking exercise.

When the upright frame 11 moves in the arrow direction to the position shown in section (b) of FIG. 1, the handle bar 13 pivotally connected with the plank 15 is inclined at a smaller angle. Accordingly, the plank 15 from the lower end of the handle bars 13 to the crank 16 is situated in a horizontal position. In this way, a walking exercise on a flat surface may be simulated when the operator treads on the planks 15 for an oval-tracked walking exercise.

When the upright frame 11 further moves in the arrow direction to the position shown in section (c) of FIG. 1, the handle bar 13 pivotally connected with the plank 15 is inclined at a larger angle so that the plank 15 from the lower end of the handle bars 13 to the crank 16 is tilted at an angle of θ in an uphill position. In this way, a walking exercise in uphill position may be simulated when the operator treads on the planks 15 for an oval-tracked walking exercise.

Figure 2:
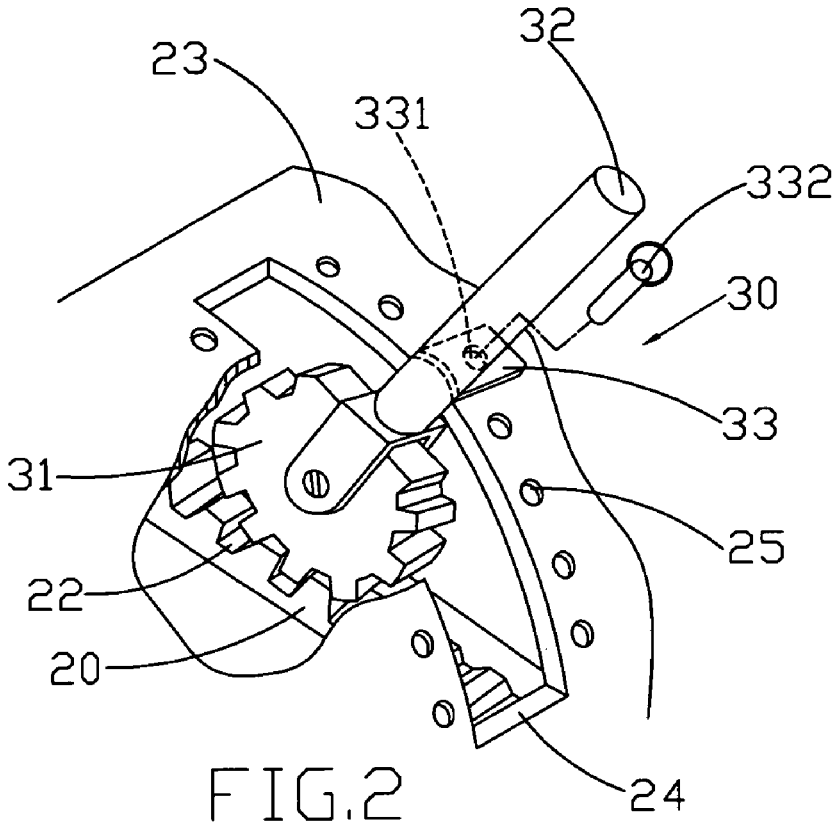
FIG. 2 is a perspective view of the drive mechanism of FIG. 1 in manual mode.

In addition, a drive mechanism 30 is necessary for the simulation of the walking exercise in uphill or downhill position. As shown in FIGS. 1 and 2, the drive mechanism 30 includes a drive pinion 31 and a control lever 32 to bring the drive pinion 31 in rotation. The drive pinion 31 with a number of teeth is adapted to engage with the teeth 22 of a rack 20. When the control lever 32 shifts in the arrow direction shown in the drawings, the upright frame 11 moves due to the engagement of the rack 20 and the drive pinion 31 from the position (a) via the position (b) to the position (c). To the contrary, when the control lever 32 shifts in the direction opposite to the arrow shown in the drawings, the upright frame 11 moves from the position (c) via the position (b) to the position (a).

After the position of the upright frame 11 is determined by the shift of the control lever 32, the swing of both handle bars 13 allows the planks 15 at both sides to move in uphill, flat or downhill position. Moreover, a plurality of positioning holes 25 are regularly spaced along a slot 24 on a housing 23 of the drive mechanism 30. The control lever 32 projecting from the slot 24 is swingable inside. Meanwhile, the control lever 32 includes a positioning tongue 33 with a hole 331. A pin 332 or bolt passing through the hole 331 of the positioning tongue 33 and one of the positioning holes 25 may temporarily fix the control lever 32 and the drive pinion 31 in position. In removing the pin 332, the control lever 32 is shift able to move the drive pinion 31 for determining the position of the upright frame 11.

The aforementioned drive mechanism 30 is manually operated by moving the control lever 32 to control the reciprocating shift of the upright frame 11. In this way, the handle bars 13 and the planks 15 are synchronically adjustable to simulate the oval-tracked walking exercise in uphill or downhill position. Therefore, the drive mechanism 30 may be operated in manual mode. Next, the drive mechanism 30 in several automatic modes will be described in the following text.

Figure 3:
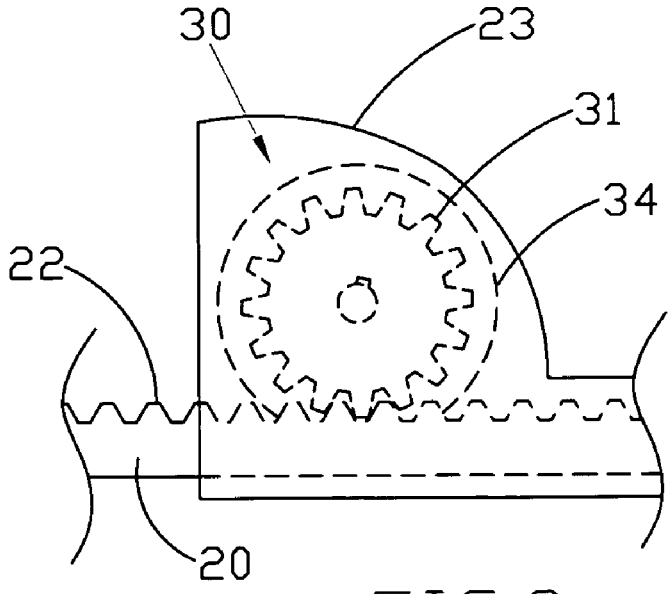
FIG. 3 is a simplified drawing of the drive mechanism of FIG. 1 in automatic mode.

As shown in FIG. 3, the drive mechanism 30 received within the housing 23 includes a motor 34 and a motor-driven pinion 31. The number of revolution of the motor 34 can be set from an electronic console (not-shown) on the frame unit 10. In this way, the position of the reciprocating movement of the rack 20 in mesh with the drive pinion 31 may be determined. Since the teeth 22 of the rack 20 are in mesh with the teeth of the drive pinion 31, the rack 20 stands still when it has been moved to a preset position. Accordingly, the drive mechanism 30 is operated in an automatic mode.

Figure 4:
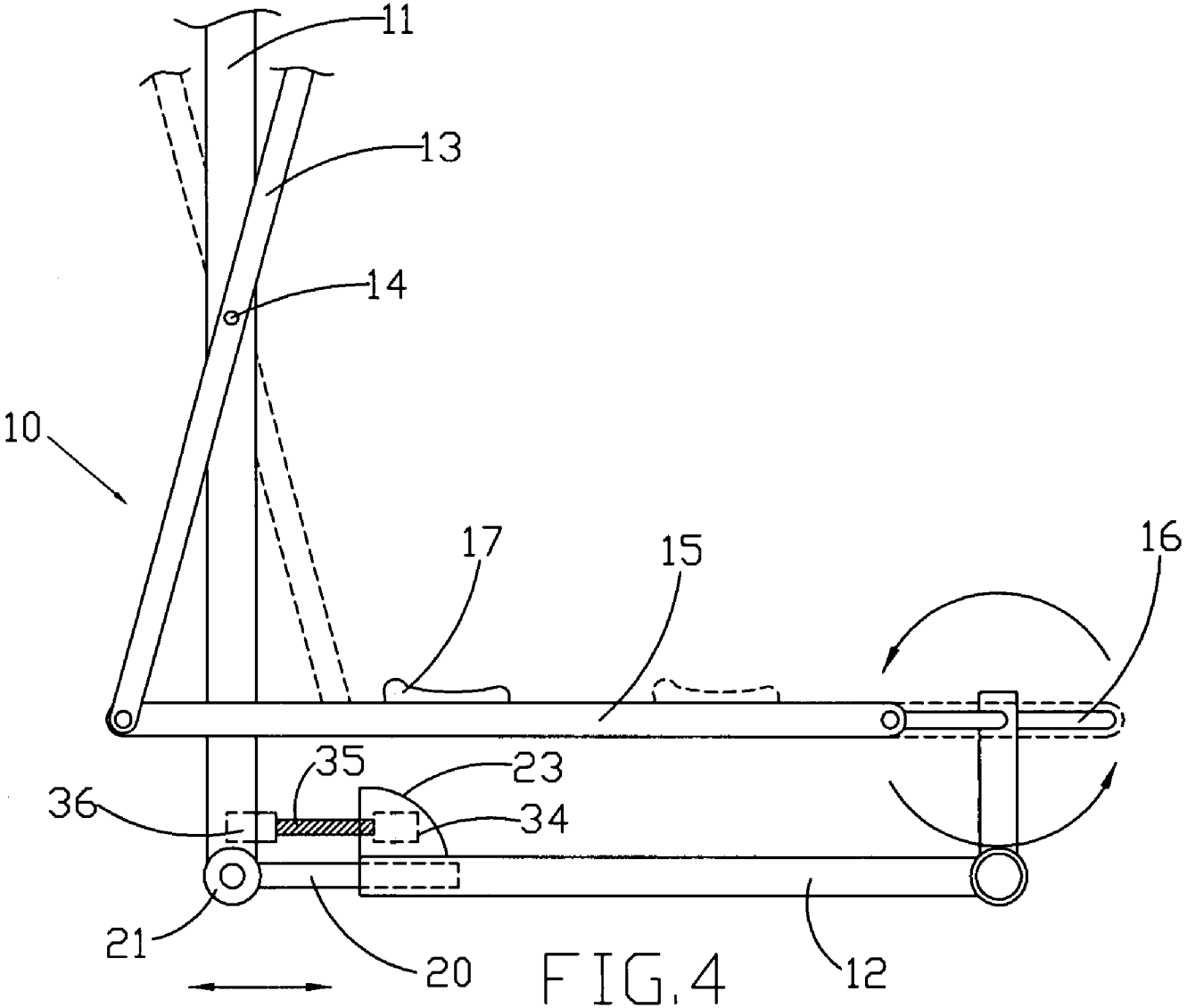
FIG. 4 is a schematic drawing of an oval-tracked exercise apparatus of the invention with another embodiment of the automatically operated drive mechanism.
Figure 5:
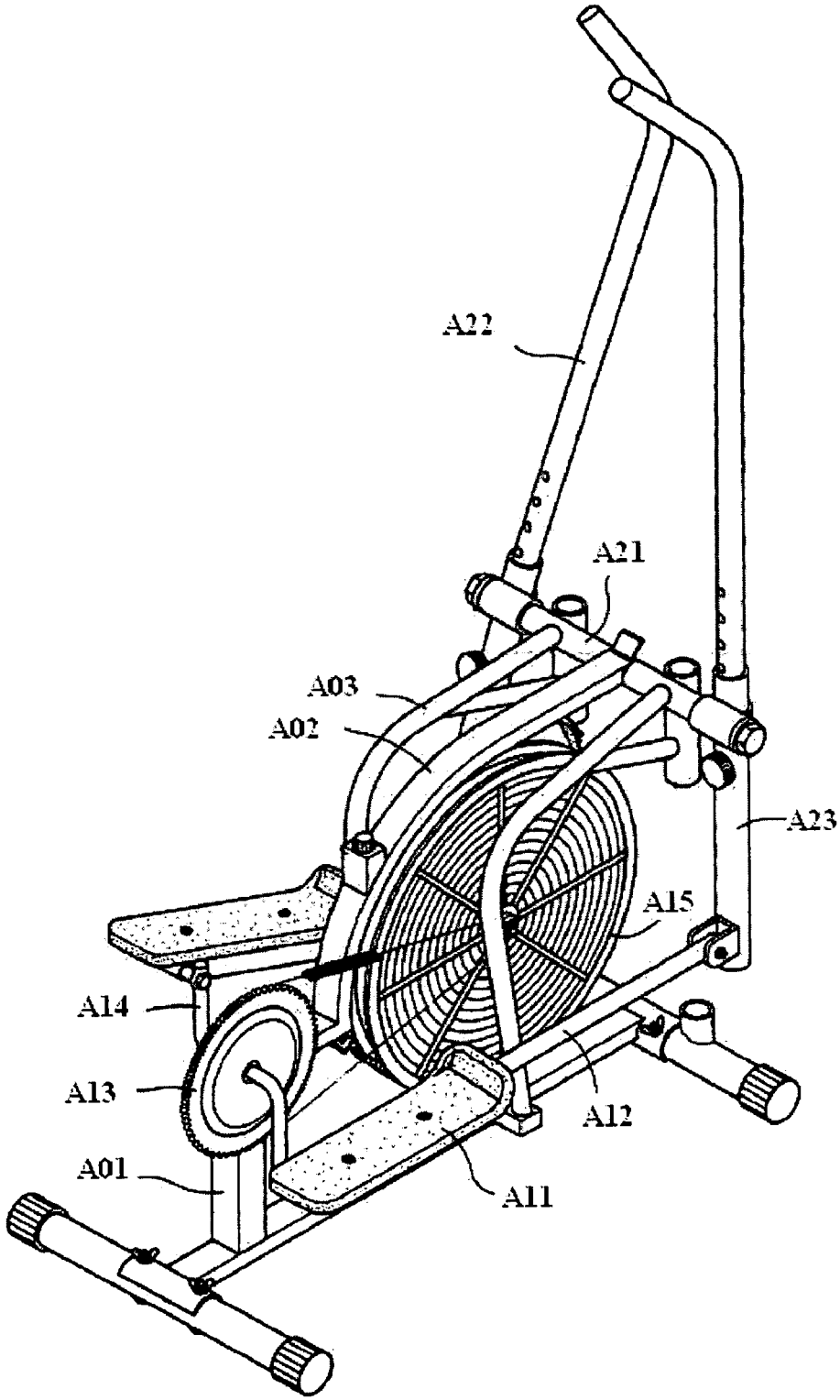
FIG.5 PRIOR ART
FIG. 5 is a perspective exploded view of a conventional oval-tracked exercise apparatus.
Figure 6:
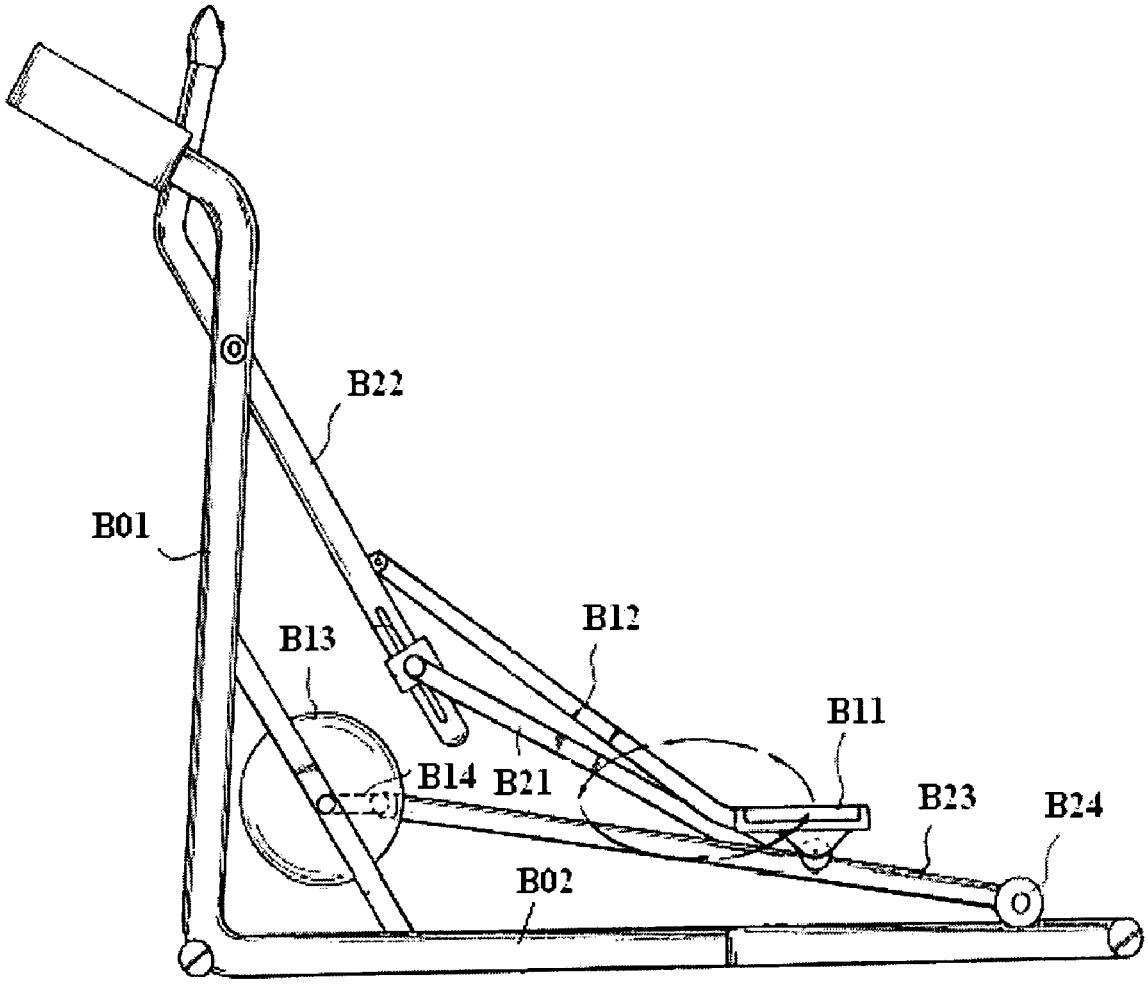
FIG.6 PRIOR ART
FIG. 6 is a side view of another conventional oval-tracked exercise apparatus.
Figure 7:
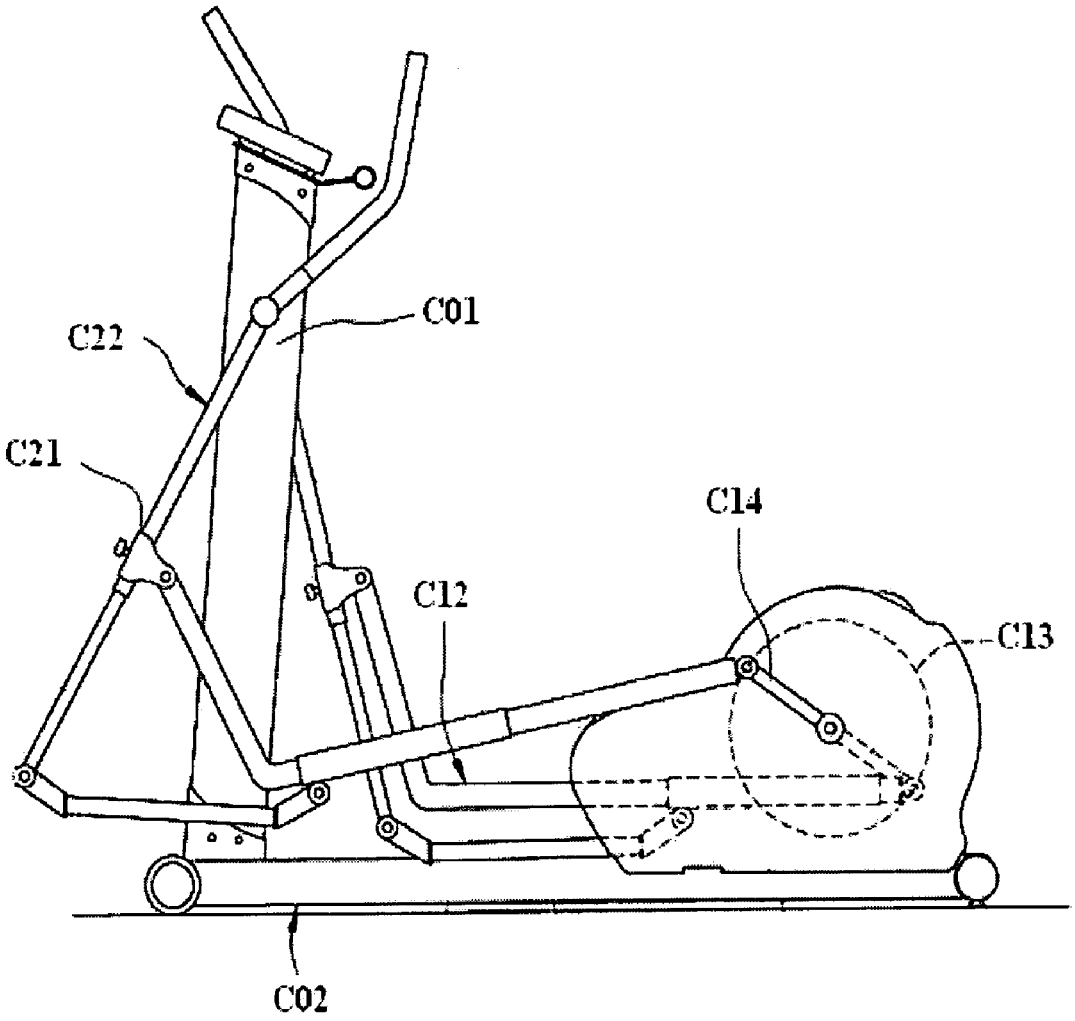
FIG.7 PRIOR ART
FIG. 7 is a side view of a further conventional oval-tracked exercise apparatus.

Furthermore, as shown in FIG. 4, the drive mechanism 30 includes a motor 34 received within the housing 23. The motor 34 drives a spindle 35 in screwed connection with a socket 36 on the upright frame 11. The number of revolution of the motor-driven spindle 35 can be set from an electronic console (not-shown) on the frame unit 10. In this way, the position of the reciprocating movement of the upright frame 11 may be determined under the influence of the rack 20. Since the spindle 35 and the socket 36 are screwed together, the upright frame 11 stands still when it has been moved to a preset position. Accordingly, this drive mechanism 30 is operated in an automatic mode as well.

Therefore, the advantages of the aforementioned apparatus in contrast to the conventional one can be concluded as follows:

1. The planks 15 at both sides are adjustable to allow a simulation of an oval-tracked walking exercise in uphill or downhill position. So, a balance during the oval-tracked exercise session is achieved.
2. Unlike the prior art that the handlebars have to be adjusted individually, the adjustment of the angle of the planks may be completed by the reciprocating movement of the upright frame.
3. The oval-tracked exercise apparatus of claim 1 wherein the adjusting mechanism further includes means for driving a spindle in connection with the connecting rod, and wherein the spindle is adapted to move the connecting rod in the position-limiting tube 21 to a prearranged position while the upright frame is synchronically swiveled to a preset angle so that the adjusting mechanism is automatically operated.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An oval tracked exercise apparatus with an adjusting mechanism having a frame unit comprising:

a) a base frame having a drive mechanism located on a first end thereof;

b) a guide rail slidable inserted into the base frame and being controlled by the drive mechanism;

c) an upright frame having a bottom end connected to the guide rail and being movable between extended and retracted positions relative to the base frame, the upright frame is selectively adjusted to a fixed position located between the extended position and the retracted position by the drive mechanism positioning the guide rail;

d) two hanging handle bars, a middle section of one of the two hanging handle bars is pivotally connected to each of two opposing sides of the upright frame;

e) two cranks located above a second end of the base frame, each of the two cranks having a second end pivoting around a first end thereof; and f) two planks movable between uphill and downhill positions, a first end of one of the two planks is pivotally connected to a bottom end of each of the two hanging handle bars, a second end of one of the two planks is pivotally connected to the second end of each of the two cranks, the two planks alternatingly moving upwardly and downwardly, wherein, the two planks selectively moving between the uphill and the downhill positions when the upright frame moves between the extended and the retracted positions.

2. The oval tracked exercise apparatus according to claim 1, further comprising a housing having a slot, the guide rail has teeth, the drive mechanism is located in the housing, the drive mechanism has a control lever and a drive pinion, the drive pinion having teeth engaging the teeth of the guide rail, the control level extending outwardly through the slot in the housing, the control lever selectively rotating the drive pinion and controlling a movement of the guide rail.

3. The oval tracked exercise apparatus according to claim 1, wherein the guide rail has teeth, the drive mechanism has a motor and a motor-driven pinion, the motor-driven pinion has teeth engaging the teeth of the guide rail, the motor selectively rotating the motor-driven pinion and controlling a movement of the guide rail.

4. The oval tracked exercise apparatus according to claim 1, further comprising a socket located on the upright frame, the drive mechanism has a motor and a spindle threadedly engaging the socket, the motor selectively rotating the spindle and controlling a movement of the upright frame.

* * * * *